US006196153B1

(12) United States Patent
Brunet

(10) Patent No.: US 6,196,153 B1
(45) Date of Patent: Mar. 6, 2001

(54) MARKER SUITABLE AS A GOLF FAIRWAY MARKER

(76) Inventor: Jean-Guy Brunet, 1917 Indian Creek Rd., Limoges, Ontario (CA), K0A 2M0

( * ) Notice: Subject to any disclaimer, the term of this patent is extended or adjusted under 35 U.S.C. 154(b) by 0 days.

(21) Appl. No.: 09/305,374

(22) Filed: May 5, 1999

(51) Int. Cl.[7] ..... G01D 21/00

(52) U.S. Cl. ..... 116/209; 116/200; 116/210; 40/610

(58) Field of Search ..... 116/209, 202, 116/211, 200, 210, DIG. 7, DIG. 8

(56) References Cited

U.S. PATENT DOCUMENTS

| | | | | |
|---|---|---|---|---|
| 3,796,181 | * | 3/1974 | Collins | 116/210 |
| 4,489,669 | | 12/1984 | Carman | 116/202 |
| 4,729,337 | * | 3/1988 | Schopp | 116/DIG. 8 |
| 5,219,171 | | 6/1993 | Kirby et al. | 273/32 |
| 5,357,897 | * | 10/1994 | Bailey | 116/209 |
| 5,441,257 | * | 8/1995 | Sheaffer | 116/209 |
| 5,474,017 | * | 12/1995 | Mohebbi et al. | 116/209 |
| 5,607,153 | * | 3/1997 | Bailey | 116/209 |
| 6,095,081 | * | 8/2000 | Gochenour | 116/209 |

* cited by examiner

*Primary Examiner*—Diego Gutierrez
*Assistant Examiner*—Yaritza Guadalupe
(74) *Attorney, Agent, or Firm*—Jones, Tullar & Cooper, P.C.

(57) ABSTRACT

A marker suitable for use in a golf fairway having a base portion suitable for installation in a ground hole, and a hollow upper body portion fixed to the upper end of the base portion which includes a dome formed of resilient material. The dome has a normal, unstressed raised condition in which it protrudes above ground level, to be readily visible to golfers, and has a depressed condition in which it is close to ground level and in which the material is stressed such that it tends to move to the normal, raised condition. A generally closed chamber beneath the dome has one-way valve means which allows air to be rapidly expelled from the chamber when the dome is depressed but restricts air flow into the chamber to delay recovery from the depressed condition.

6 Claims, 2 Drawing Sheets

MARKER SUITABLE AS A GOLF FAIRWAY MARKER

BACKGROUND OF THE INVENTION

1. Field of the Invention

The present invention relates to markers suitable for use in golf fairways, especially to indicate the distance of a particular position on the fairway to the green. The markers may also be used as distance markers for golf driving ranges, as markers for airport runways and taxiways or for soccer field corners, and as benchmarks in parks of public lands.

2. Prior Art

It is common for distance markers to be placed on golf fairways to help players estimate the distance of their ball to the green. Many of these markers are set flat into the ground and as such are hard to find.

Markers have also been used which project above the ground. However, such markers either have to be removed when the grass is being mowed, or have to be made very flexible so that they can be pushed flat by a mowing machine. The latter type of marker has two drawbacks. Firstly it is likely to become broken with repeated bending caused by frequent mowing operations. Secondly, it is not favoured by golfers since it interferes with the rolling of balls.

U.S. Pat. No. 5,219,171, which issued Jun. 15, 1993 to Kirby et al., proposes a golf fairway marker which collapses from a raised condition to a retracted, lowered condition when run over by a mowing machine. This includes a spring loaded central plunger and a series of trapezoidal leaves each having their narrower end held by the top of the plunger, and the wider end held by a surrounding support ring. This construction, in addition to being somewhat complex, has the drawback that the spring causes the plunger to rise as soon as the lead roller of a mower has passed over it, and so is subjected to repeated impacts by other parts of the mower.

U.S. Pat. No. 4,489,669, which issued Dec. 25, 1984 to Carman, shows a golf marker having a base and having an upper portion including a resilient dome which is depressed when a mower passes over it. There is nothing to delay recovery of the resilient dome to its normal position, so it would be expected that after a mower wheel or roller has run over it, the dome would spring back to its normal position where it could be cut by mower blades.

SUMMARY OF THE INVENTION

The present invention provides a marker having a resilient dome, but in which, unlike in the Carman construction, the return of the dome to the raised position is delayed at least until the whole of a mowing machine has passed over it.

According to the present invention, a marker suitable for use in a golf fairway comprises:

a base portion suitable for installation in a ground hole, a hollow upper body portion fixed to the upper end of said base portion, said upper body including a dome formed of resilient material and having a normal, unstressed raised condition in which it protrudes above the level of ground in which the base portion is installed to be readily visible to golfers, and having a depressed condition in which it is close to ground level and in which the material is stressed such that it tends to move to the normal, raised condition, and motion control means for delaying movement of the dome from the depressed condition to the raised condition.

Preferably, a partition defines a generally closed chamber beneath the dome, and one-way valve means allows air to be readily expelled from the chamber when the dome is depressed but restricts air flow into the chamber to create a partial vacuum and to delay recovery from the depressed condition. The valve means may include an aperture in the partition, and a valve member below the partition which is readily opened by positive pressure air in the chamber, but which is closed by spring means when the air pressure in the chamber is at or below atmospheric pressure.

BRIEF DESCRIPTION OF THE DRAWINGS

Preferred embodiments of the invention will now be described by way of example with reference to the accompanying drawings, in which.

DETAILED DESCRIPTION

Figure 1:
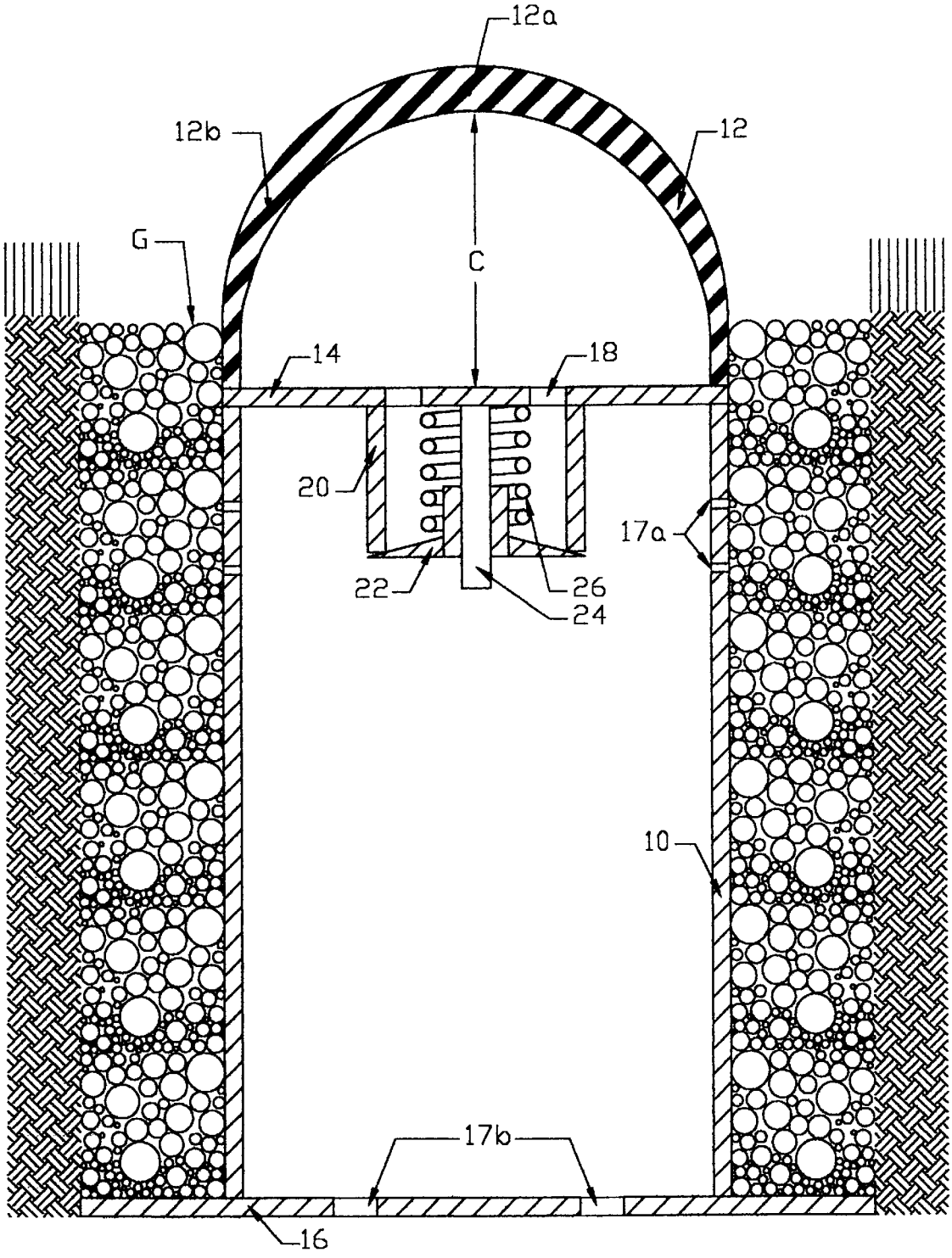
FIG. 1 shows a sectional elevation through an embodiment of the invention.

Referring to FIG. 1, the marker includes a hollow body, preferably of plastic material, having a main cylindrical base portion 10 and a short hollow upper body portion in the form of a dome 12. The two portions are separated by a horizontal, circular partition 14. The base portion 10 is closed by a horizontal wall 16 providing flanges which extend outwardly from the sides of the base 10 and anchor the marker in the ground.

The base portion 10 is suitable for being sunk as shown into a hole of cylindrical shape in a golf fairway, and its upper end is located just below the level of the ground G, preferably 1 to 2 cm below this ground level. The overall height of the body 10 is preferably between 30 and 40 cm., and the diameter is about 15 cm. The base portion 10 has small drainage holes 17*a* in the sides and larger drainage holes 17*b* in the bottom.

Figure 2:
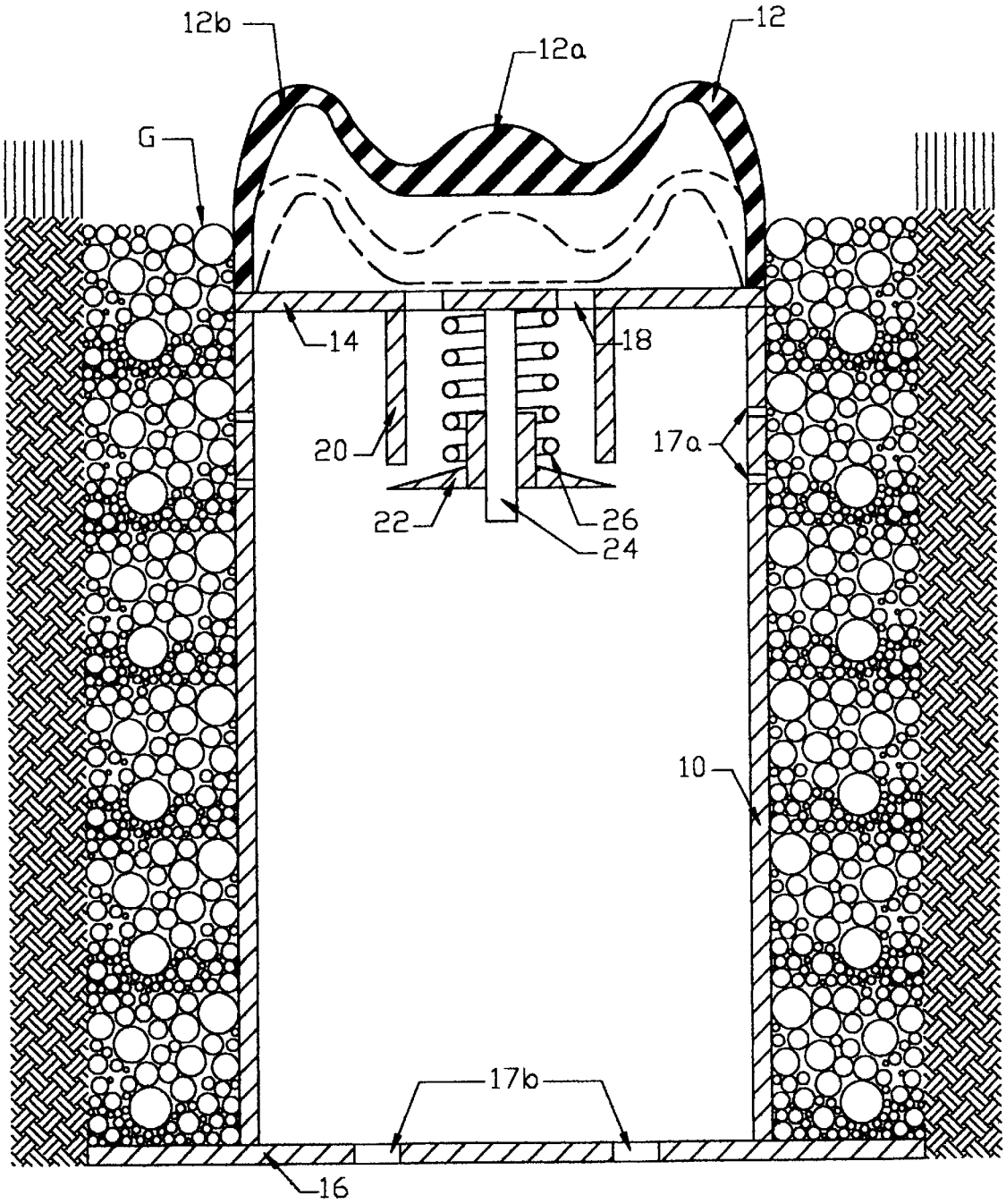
FIG. 2 shows a similar view of the same embodiment of the invention in successive depressed states.

The dome 12 is formed of a resilient, rubber-like material having a central thickened area 12*a* surrounded by outer areas 12*b* which are thinner and more flexible than the central area. The space between the dome and the partition 14 is a generally closed chamber C provided with vent holes and a valve to be described. The form of the dome is such that when a mower wheel or roller passes over it the outer areas 12*b* flex and the central area 12*a* is depressed into the successive positions shown in FIG. 2, i.e. firstly into the full line position and secondly to the broken line position, where it is clear of a mower. In the latter position the dome is largely below the ground level.

Motion control means to delay the recovery of the dome 12 to its raised position include vent apertures 18 in the partition 14, and a one-way valve 20 mounted below the partition which allows air to be readily expelled from the generally closed chamber C under the dome while restricting air inlet into the dome; the vent apertures 18 being the only air inlets into the chamber. In this way the chamber is kept under negative pressure or partial vacuum for a short period after the dome is depressed, and this delays return of the dome to the unstressed condition. The one-way valve includes a valve member 22 mounted on a valve stem 24, the valve stem being surrounded by a tension spring 26 which urges the valve member up into the closed position.

In operation, the dome 12 is pushed down into the depressed position when the lead roller of a mowing machine passes over it, expelling air from vents 18 which are then closed by the valve member. The dome remains depressed for several minutes so that other parts of the mower will not damage it, until enough air has leaked back into the chamber C for the dome to recover to its raised position when the mower can be expected to have moved on.

Instead of the valve described, a simpler flap valve or any other kind of one way valve may also be used.

I claim:

1. A marker suitable for use in a golf fairway comprising:

a base portion suitable for installation in a ground hole so that an upper end of said base portion is below ground level, a hollow upper body portion fixed to the upper end of said base portion, said upper body portion including a dome formed of resilient material and having a normal, unstressed raised condition in which it protrudes above the said ground level to be readily visible to golfers, and having a depressed condition in which it is close to said ground level and in which the material is stressed such that it tends to move to the normal, raised condition, and motion control means for delaying movement of the dome from the depressed condition to the raised condition;

and wherein said motion control means includes a partition which defines a generally closed chamber beneath the dome; and wherein the motion control means includes one-way valve means which allows air to be rapidly expelled from the chamber when the dome is depressed but restricts air flow into the chamber to delay recovery from the depressed condition.

2. A marker according to claim 1, wherein said valve includes an aperture in said partition, and a valve member below the partition which is readily opened by air pressure in the chamber when said air pressure is above atmospheric, but which is closed by spring means when the air pressure in the chamber becomes atmospheric or negative.

3. A marker according to claim 1, wherein the dome has a central thickened area surrounded by areas which are thinner and more flexible than said central area.

4. A marker according to claim 1, wherein the base portion is in the form of a hollow cylinder having the same diameter as the upper body portion.

5. A marker suitable for use in a golf fairway comprising:

a base portion suitable for installation in a ground hole, a hollow upper body portion fixed to an upper end of said base portion, said upper body portion including a dome formed of resilient material and having a normal, unstressed raised condition in which it protrudes above the base portion, and having a depressed condition in which it is close to the upper end of the base portion, in which condition the material is stressed such that it tends to move to the normal, raised condition, and wherein the dome communicates with a generally closed chamber beneath the dome, and wherein motion control means are provided in the form of a valve which allows rapid expulsion of air from the chamber but restricts air flow into the chamber and so delays movement of the dome from its depressed to its normal raised condition.

6. A marker according to claim 5, wherein the chamber is formed by a partition beneath the dome, and wherein said valve includes an aperture in said partition, and a valve member below the partition which is readily opened by air pressure in the chamber which is above atmospheric, but which is closed by spring means when the air pressure in the chamber becomes atmospheric or negative.

* * * * *